United States Patent [19]

Tamaoki et al.

[11] Patent Number: 4,865,056

[45] Date of Patent: Sep. 12, 1989

[54] EASILY BREAKABLE PLASTIC CAPSULE AND A WATER FILTER FOR A CIGARETTE USING THE SAME

[75] Inventors: Akimichi Tamaoki; Shinichiro Tanaka; Morio Kondo, all of Yokohama; Masami Kawata, Tokyo; Ichiro Hirose, Tokyo; Hiroshi Uematsu, Tokyo; Kazuto Minami, Yokohama; Mitsuyuki Kobiyama, Matsudo, all of Japan

[73] Assignees: Japan Tobacco Inc.; DAI Nippon Printing Co., Ltd., both of Tokyo, Japan

[21] Appl. No.: 145,283

[22] Filed: Jan. 19, 1988

[30] Foreign Application Priority Data

Jan. 23, 1987 [JP] Japan ..... 62-12518
May 6, 1987 [JP] Japan ..... 62-108894

[51] Int. Cl.[4] ..... A24D 3/06; B65D 41/02

[52] U.S. Cl. ..... 131/337; 131/173; 220/265; 220/207

[58] Field of Search ..... 131/173, 335, 337; 220/207, 359, 265, 266, 89 R, 89 A; 222/541, 107, 95; 401/132

[56] References Cited

U.S. PATENT DOCUMENTS

| | | | |
|---|---|---|---|
| 2,755,206 | 7/1956 | Statia | 131/337 |
| 3,502,084 | 3/1970 | Carty | 131/337 |
| 3,575,180 | 4/1971 | Carty | 131/337 |
| 3,602,235 | 8/1971 | Dock | 131/337 |
| 3,884,246 | 5/1975 | Walker | 131/337 |
| 3,991,773 | 11/1976 | Walker | 131/337 |

FOREIGN PATENT DOCUMENTS 62-22583 1/1987 Japan .

*Primary Examiner*—V. Millin
*Assistant Examiner*—J. Welsh
*Attorney, Agent, or Firm*—Nixon & Vanderhye

[57] ABSTRACT

An easily breakable plastic capsule according to the present invention comprises a hollow cylindrical body capable of elastic deformation. The body is packed with a fluid material. An end wall of the body is formed with a plurality of radially extending grooves. When the body is deformed elastically, the bottom walls of the grooves are broken, so that the material flows out of the body through tears in the grooves. A water filter according to the present invention comprises a casing, made of paper and coupled to a cigarette, and a filter member and the capsule arranged in the casing. The grooved end wall of the capsule is situated in close vicinity to the filter member.

25 Claims, 4 Drawing Sheets

EASILY BREAKABLE PLASTIC CAPSULE AND A WATER FILTER FOR A CIGARETTE USING THE SAME

BACKGROUND OF THE INVENTION

The present invention relates to an easily breakable plastic capsule, and more particularly, to an easily breakable plastic capsule adapted to use in the fields of foodstuff, medical supplies, industrial chemicals, etc. The invention also relates to a water filter for a cigarette using the capsule of this type.

In the food industry, for example, miniature containers or so-called capsules are used conveniently for packing liquid or powdery materials which are consumed in very small quantities. These materials include cream for coffee, sugar, liquid sweetenings, seasonings, table salt, spices, etc. The capsules are not opened until the filler materials therein are going to be used actually. Thus, a fixed amount of material can be taken out of each capsule by opening the same. Since these capsules are small-sized, however, they sometimes cannot be unsealed easily, or the filler materials may be unexpectedly spilled out of the capsules at the time of unsealing.

Such an awkward situation may be experienced not only with the aforementioned capsules for foodstuff, but also with capsules used in various other fields, including medical supplies, industrial chemicals, household goods, etc.

Besides these fields, the tobacco industry has recently come to require development of water filters which can be attached to cigarettes. Basically, these water filters comprise a filter housing open at both ends, a filter member contained therein, and water with which the filter member is impregnated. More specifically, one end of the filter housing serves as a socket for a cigarette, while the other end is formed as a filter tip. In these water filters, however, a seal cap must be attached to each end of the filter housing, in order to prevent the water in the filter member from being evaporated before use. At the start of using one such water filter, therefore, the removal of the seal caps require time. On account of the aforesaid structural problem, moreover, the conventional water filters cannot be used as filters for filter cigarettes. Thus, there is a demand for the development of water filters which can be applied to cigarettes by untilizing the aforementioned capsules.

SUMMARY OF THE INVENTION

A first object of the present invention is to provide an easily breakable capsule, and a second object of the invention is to provide a water filter for a cigarette using such a capsule.

The first object of the invention is achieved by an easily breakable plastic capsule, which comprises a hollow body formed of plastic material, the body having a packed chamber and capable of elastic deformation when subjected to external force, the packed chamber being sealable after being packed with the fluid material; and at least one thin-walled region provided to the wall of the body, the thin-walled region being thinner than any other regions of the body and thin enough to be broken when the body is subjected to external force.

According to the easily breakable capsule described above, the thin-walled region can be broken by only elastically deforming the capsule body by means of external force, e.g., by squeezing the body between fingers. Thus, the capsule can be unsealed with ease.

The second object of the invention is achieved by a water filter, which comprises a flexible casing in the form of a tube open at both ends, one end of the casing serving as a socket for a cigarette and the other end serving as a mouthpiece; at least one filter member for the cigarette contained in the casing and capable of being impregnated with a liquid; an easily breakable plastic capsule disposed in close vicinity to the filter member in the casing; and guide means for guiding a flow of smoke from the cigarette into the casing, ranging from the socket to the mouthpiece, the capsule including a hollow cylindrical body formed of plastic material and capable of elastic deformation when subjected to external force, the cylindrical body having a packed chamber and an end wall in the vicinity of the filter member, the packed chamber being sealable after being packed with the liquid composed mainly of water, and at least one thin-walled region provided to the end wall of the body, the thin-walled region being thinner than any other regions of the body and thin enough to be broken when the body is subjected to external force applied through the casing.

According to the water filter described above, the thin-walled region can be easily broken to allow the filter member to be impregnated with the liquid in the capsule, by only elastically deforming the capsule body together with the casing, at the start of use. At this point of time, therefore, the water filter can fulfill its essential function.

Thus, the water filter of the present invention is constructed so that the filter member cannot be impregnated with the liquid in the capsule until the capsule is opened at the start of use. When the water filter is not needed for actual use, therefore, the liquid can be held securely in the capsule without being evaporated. Accordingly, unlike conventional water pipes, the water filter need not be fitted with a seal cap at each end. In consequence, the water filter and a cigarette can be coupled by fitting the cigarette into the socket of the filter during the manufacture of the cigarette. Moreover, the liquid for the water filter can be handled more easily. Thus, the water filter of the invention is well suited for use with a cigarette.

DETAILED DESCRIPTION OF THE PREFERRED EMBODIMENTS

Figure 1:
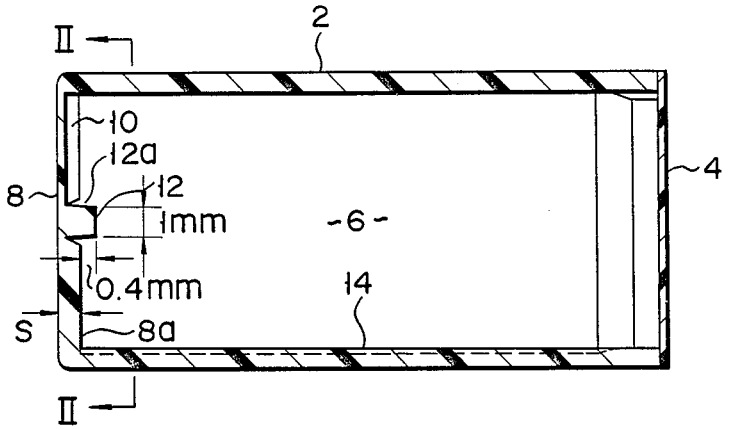
FIG. 1 is a sectional view of an easily breakable plastic capsule according to a first embodiment of the present invention, as taken along line I—I of FIG. 2.

Referring now to FIG. 1, there is shown an easily breakable plastic capsule according to the present invention, which comprises a hollow cylindrical body 2 open at one end. Body 2 is liable to elastic deformation. Available materials for body 2 include thermoplastic resins, such as polyethylene, polypropylene, polystyrene, polyvinyl chloride, polyvinylidene chloride, polyester, polycarbonate, polyamide, etc., and mixtures of these resins. In this embodiment, the actual material of body 2 is low-density polyethylene obtained by mixing SHOLEX-9300 (trademark) with NOVATEC M-450 (trademark) at a ratio of 3:7 by weight, in consideration of the compressive strength, breaking strength, and water-vapor permeability.

The open end of body 2 is closed in a liquid-tight manner by means of seal film 4. Thus, packed chamber 6 is defined inside body 2. The capacity of chamber 6, which may be suitably set depending on the application of the capsule, generally ranges from 0.15 cc to several cubic centimeters. A filler material to be packed in chamber 6, which is selected also according to the application, is a fluid material, such as a liquid or powder.

In this embodiment, seal film 4 is a laminate or coated film composed of an aluminum foil and a thermoplastic resin. The film is fused to the open end of body 2 by heating. Film 4 is not limited to these materials, and may alternatively be a simple film of a thermoplastic resin. It is necessary only that the film material be strong enough not to be broken when body 2 is deformed elastically.

Figure 2:
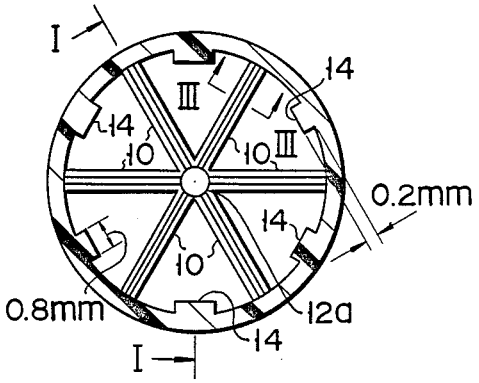
FIG. 2 is a sectional view taken along line II—II of FIG. 1.

As seen from FIGS. 1 and 2, a plurality of grooves 10, e.g., six in number, are formed on inner surface 8*a* of end wall 8 of body 2. Extending radially, these grooves are arranged uniformly so that central portion 12 of wall 8 is left uncut. Annular groove 12*a* is formed around portion 12, whereby the respective inner ends of grooves 10 are connected to one another. In this embodiment, the angle formed between two opposite inner wall surfaces of each groove 10 is set within a range of 35° to 120°, and preferably, is set to 90°.

Figure 3:
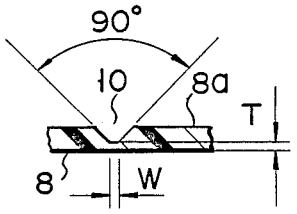
FIG. 3 is a sectional view taken along line III—III of FIG. 2.

The configuration of grooves 10 will be described further in detail. Each groove 10 has a bottom wall with predetermined width W. As shown in FIG. 3, thickness T of the bottom wall preferably ranges, for example, from 1/20 to 3/5 of thickness S of the wall of body 2 or end wall 8. This thickness is a thickness such that the bottom wall can be broken when body 2 is deformed elastically by external force.

Grooves 10 can be formed simultaneously with body 2, as a general structure, only if a die used for injection molding of the whole body is provided with ridges for the formation of grooves 10.

As seen from FIG. 1, central portion 12 of end wall 8 projects slightly from inner surface 8*a* of wall 8. The diameter of portion 12 may be determined as required.

Six ribs 14 are formed on the inner peripheral surface of body 2. As shown in FIG. 2, these ribs are arranged circumferentially, at regular intervals, between grooves 10. Each rib 14 extends from end wall 8 to a point near the open end of body 2.

According to the easily breakable plastic capsule described above, end wall 8 is deformed elastically if the peripheral wall of body 2 is squeezed by fingers. By the elastic deformation of wall 8, stress is concentrated on the bottom walls of grooves 10, so that the bottom walls can be broken easily. Thus, the capsule is unsealed, and the filler material therein is allowed to flow out.

In the capsule of the present invention, the bottom walls of grooves 10 cannot be broken unless body 2 is subjected to elastic deformation. Thus, the capsule can be handled with ease before and during transportation.

The capsule of the invention is not limited to the arrangement of the embodiment described above. Several modifications of the capsule will now be described. In the description to follow, like reference numerals are used to designate like members with the same functions.

Figure 4:
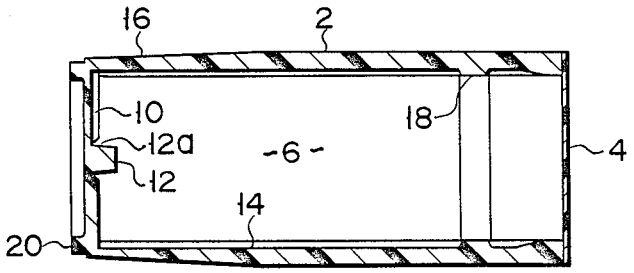
FIGS. 4, 5 and 6 are sectional views of easily breakable plastic capsules according to second, third, and fourth embodiments, respectively, of the invention.

In an easily breakable plastic capsule shown in FIG. 4, taper portion 16 is formed on the outer peripheral surface of body 2. Portion 16, which starts at end wall 8, covers about ⅓ of the overall length of body 2. At this taper portion, the thickness of the peripheral wall of body 2 is reduced gradually with distance from the middle portion of the body. Also, ring-shaped rib 18 is formed on the inner surface of the peripheral wall of body 2. Rib 18, which is situated on the open end side of body 2, interrupts grooves between ribs 14. Ring-shaped projection 20 is formed on the outer surface of end wall 8.

According to the aforementioned capsule shown in FIG. 4, taper portion 16 serves to facilitate the elastic deformation of body 2 and therefore, unsealing of the capsule.

Figure 5:
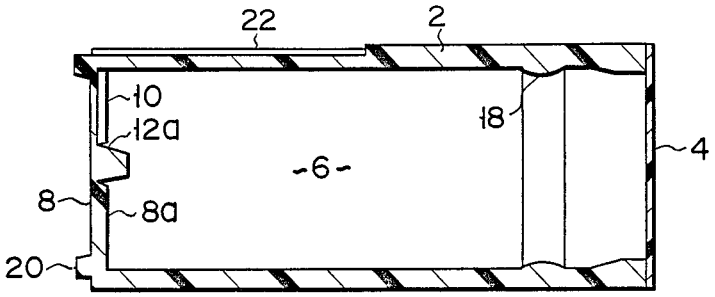

According to an easily breakable plastic capsule shown in FIG. 5, grooves 22, e.g., six in number, are formed on the peripheral wall of body 2, in place of taper portion 16 shown in FIG. 4. These grooves are arranged circumferentially at regular intervals on the outer surface of the peripheral wall of body 2. In the case of the embodiment of FIG. 5, ribs 14 are not provided on the inner wall surface of body 2.

If body 2 has grooves 22 as aforesaid, the peripheral wall of body 2 can be thinned, as in the case of the arrangement including taper portion 16, so that body 2 can be elastically deformed with ease.

Figure 6:
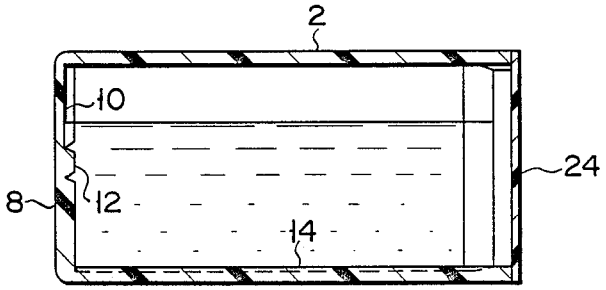

In an easily breakable plastic capsule shown in FIG. 6, seal film 24 composed only of an aluminum foil is used in place of seal film 4. Film 24 is bonded to the open end of body 2 by means of a thermoplastic bonding agent. Available materials for the thermoplastic bonding agent include adhesive polyolefin resin, low-density polyethylene, etc.

Unlike seal film 4 of the foregoing embodiments, seal film 24 of the embodiment of FIG. 6 is subjected to a tensile force when it is deformed elastically. Thus, film 24 is broken simultaneously with grooves 10 of end wall 8. Thus, the thickness of film 24 is set within a range of 10 $\mu$ to 30 $\mu$, and preferably, is set to 15 $\mu$.

Figure 7:
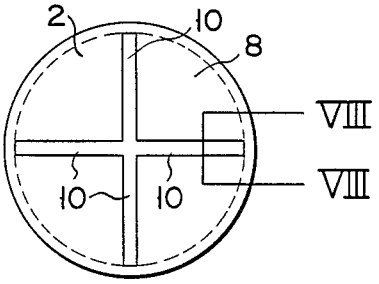
FIG. 7 is a side view of an easily breakable plastic capsule according to a fifth embodiment of the invention.
Figure 8:
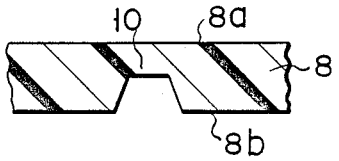
FIG. 8 is a sectional view taken along line VIII—VIII of FIG. 7.
Figure 9:
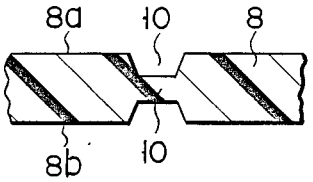
FIG. 9 is a sectional view similar to FIG. 8, showing a configuration of a groove.

In a capsule shown in FIG. 7, four grooves 10 are formed on end wall 8 of body 2. In this case, wall 8 is not provided with central portion 12. In the embodiment of FIG. 7, moreover, grooves 10 are formed on outer surface 8*b* of end wall 8, as shown in FIG. 8, instead of being formed on inner surface 8*a*. Alternatively, grooves 10 may be provided on both inner and outer surfaces 8*a* and 8*b* of end wall 8, as shown in FIG. 9.

The easily breakable plastic capsule according to the present invention is not limited to the embodiments described above, and the following various modifications (not shown) may be effected in the invention.

In any of the aforementioned embodiments, body 2 is in the form of a hollow cylinder. However, body 2 must only be a hollow structure, and its shape is not limited to any specific configuration. In other words, body 2 may have the shape of a sphere, ellipsoid, triangular prism, quadrangular prism, or the like. In the foregoing embodiments, moreover, body 2 is provided with an opening portion through which the material is filled thereinto. After body 2 is thus filled with the material, the opening portion is closed by means of seal film 4 or 24. Alternatively, however, a body may be used which is not provided with the opening portion. In this case, the material is injected into the body by using a needle or the like, and a resulting pinhole in the body is sealed by suitable means. Further, the location of the thin-walled region of body 2, in which grooves 10 are formed, is not limited to end wall 8, and may be determined as required, depending on the shape of the body.

A water filter for a cigarette using the aforementioned easily breakable plastic capsule will now be described.

Figure 10:
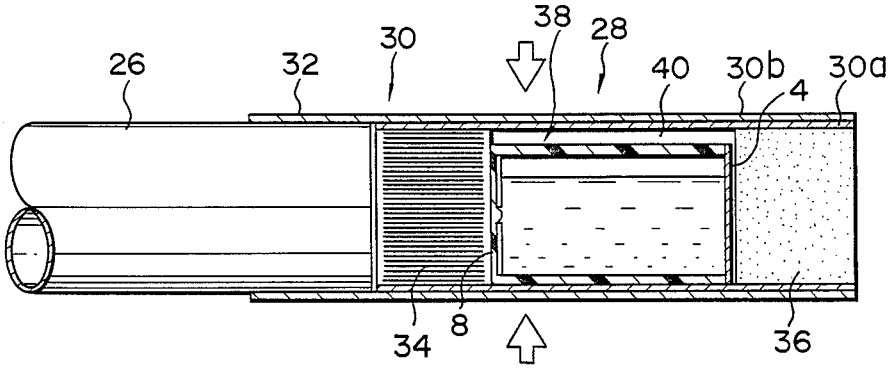
FIG. 10 is a sectional view showing an embodiment of a water filter of the present invention applied to a cigarette.

Referring now to FIG. 10, there is shown cigarette 26, which is fitted with water filter 28 according to the present invention.

Water filter 28 comprises flexible casing 30 in the form of a hollow cylindrical member made of paper. More specifically, the cylindrical member includes inner cylinder 30*a* and outer cylinder 30*b* pasted on the outer peripheral surface of cylinder 30*a*. As seen from FIG. 10, one end portion of outer cylinder 30*b* of casing 30 constitutes boss 32, which projects axially over a predetermined length from inner cylinder 30*a*. An open end of boss 32 serves as a socket for cigarette 26. Thus, one end portion of cigarette 26 is fitted in boss 32. As in the case of a conventional filter cigarette, the one end portion of cigarette 26 and boss 32 of casing 30 are coupled to each other by pasting.

A pair of filter members 34 and 36 are arranged spaced in casing 30. These members are situated individually at two opposite ends of inner cylinder 30*a*. Filter members 34 and 36 may be formed of the same filter materials as are used in conventional filter cigarettes, i.e., acetate fibers, pulp fibers, etc. Preferably, however, at least one of the filter members, member 34 in this embodiment, should be formed of hydrophobic, fusible complex fibers. The other end of casing 30, or filter member 36 constitutes a mouthpiece.

Water capsule 38, similar to the easily breakable plastic capsule of FIG. 1, is interposed between filter members 34 and 36 in casing 30. About 0.15 cc to 0.4 cc of liquid is sealed in capsule 38. In this case, the liquid is composed essentially of water. Alternatively, however, the liquid may be a water solution of sugar, tobacco essence, spices, brandy, etc.

As shown in FIG. 10, end wall 8 of body 2 of water capsule 38 is located in close vicinity to filter member 34.

The outside diameter of capsule 38 or body 2, as seen from FIG. 10, is smaller enough than the inside diameter of casing 30 to secure smoke passage 40, through which a flow of smoke from cigarette 26, passing through filter member 34, is guided to the mouthpiece via filter member 36.

In water capsule 38 used in water filter 28 for a cigarette, the length of body 2 ranges from 10 mm to 20 mm, and preferably, is 14 mm. The outside diameter of body 2 ranges from 5 mm to 12 mm, and preferably, is 7 mm. Thickness T (see FIG. 3) of the bottom wall of each groove 10 of end wall 8 is set within a range of 0.06 mm to 0.15 mm, and preferably, is set to 0.13 mm. Width W (see FIG. 3) of the bottom wall is set to 0.2 mm, for example. Moreover, thickness S (see FIG. 1) of those portions of end wall 8 other than grooves 10 is set within a range of 0.3 mm to 0.6 mm, and preferably, is set to 0.5 mm. Central portion 12 projects about 0.4 mm from the inner surface of end wall 8, and its diameter is 1 mm or thereabout. The thickness and width of each rib 14 are 0.2 mm and about 0.8 mm, respectively.

According to the water-filtered cigarette shown in FIG. 10, water filter 28 can be squeezed in the directions of the arrows by a smoker's fingers. When filter 28 is crushed in this manner, casing 30 is deformed, so that body 2 of water capsule 38 is reduced in diameter by elastic deformation. Thereupon, the bottom walls of grooves 10 of end wall 8 of body 2 are broken as aforesaid, and at the same time, the liquid in capsule 38 is ejected toward filter member 34. Thus, member 34 is impregnated with the liquid. Grooves 10 of end wall 8 extend radially, and ribs 14 are formed on the inner peripheral surface of body 2 so as to be situated between grooves 10. When body 2 is crushed, therefore, stress is concentrated on those regions of the bottom walls of grooves 10 near central portion 12, so that such regions are broken first. Accordingly, the liquid in capsule 38 is ejected intensively from the center of end wall 8.

When a user lights cigarette 26 for smoking, thereafter, water-soluble substances, such as nicotine and tar, contained in the flow of smoke from the cigarette are dissolved in the liquid with which filter member 34 is impregnated. Thus, these substances can be reduced before they reach the smoker's mouth, so that the smoker can enjoy soft smoking. Despite the presence of water capsule 38, moreover, smoke passage 40 is secured in water filter 28 during the smoking. Therefore, the smoke flow can be guided satisfactorily from cigarette 26 to the mouthpiece.

As described above, water filter 28 of the present invention is constructed so that filter member 34 is impregnated with the liquid in water capsule 38 by breaking the capsule immediately before the start of smoking. During the production of a cigarette with filter 28 of this construction, the liquid can be sealed and held securely in capsule 38. Also in a manufacturing apparatus for ordinary filter cigarettes, therefore, water capsule 38 can be handled in the same manner as filter members 34 and 36. Thus, water filter 28 of the invention can be easily used in place of a conventional cigarette filter. Moreover, the outer diameter of capsule 38 is smaller than those of members 34 and 36. In connecting cigarette 26 with casing 30 of filter 28 or inner cylinder 30*a* by means of outer cylinder 30*b*, therefore, water capsule 38 cannot be subjected to any excessive force. Thus, the capsule is prevented from being opened unexpectedly.

Since water filter 28 is provided with smoke passage 40, furthermore, it can be checked by means of a conventional defective tester of an air-circulation type.

In the embodiment of FIG. 10, moreover, end wall 8 of water capsule 38 faces filter member 34 which is situated remoter from the filter tip. At the start of use or when capsule 38 is unsealed, only member 34 is impregnated with the liquid. During smoking, therefore, the liquid in capsule 38 is prevented from flowing out to the filter tip. Thus, the taste of smoking cannot be spoiled by the liquid.

Water filter 28 of the present invention is not limited to the embodiment shown in FIG. 10. Referring now to FIGS. 11 to 18, various modifications of the water filter will be described.

Figure 11:
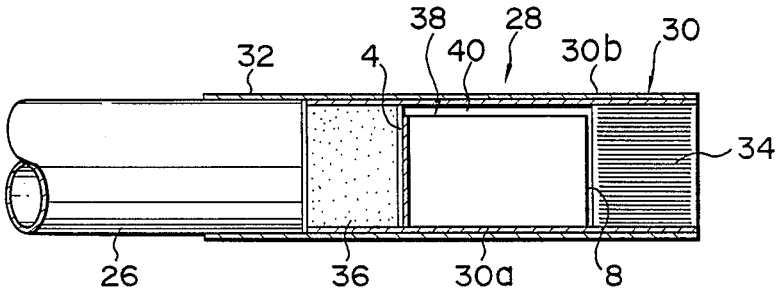
FIGS. 11 to 14 are sectional views individually showing modifications of the water filter.

In water filter 28 shown in FIG. 11, filter members 34 and 36 are situated reversely to those of the water filter of FIG. 10. In this arrangement, water capsule 38 is oriented reversely with respect to its axial direction.

Figure 12:
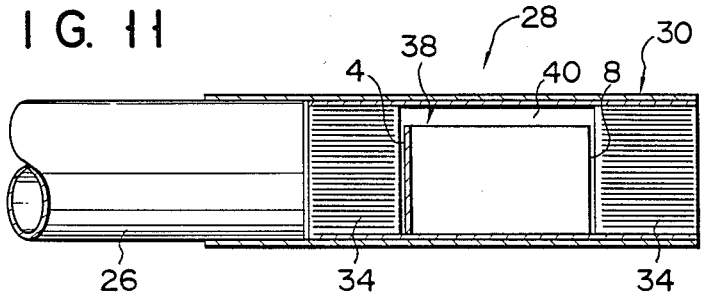

In water filter 28 shown in FIG. 12, filter member 36 is replaced with a filter member similar to filter member 34 of the water filter of FIG. 10.

Figure 13:
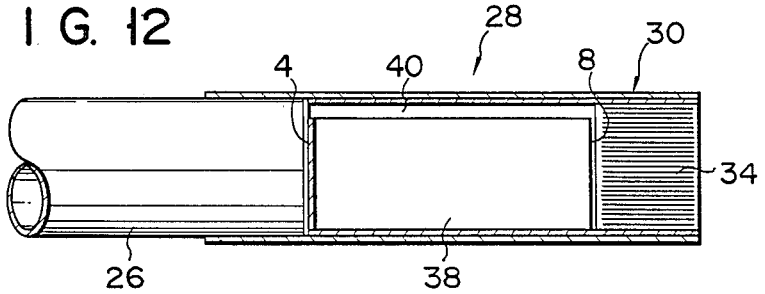

In water filter 28 shown in FIG. 13, filter member 36 of the water filter of FIG. 11 is omitted.

Figure 14:
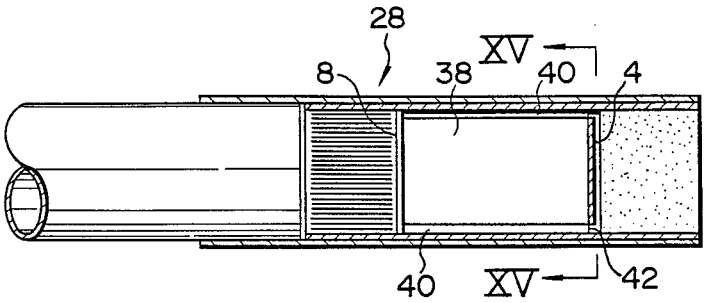
Figure 15:
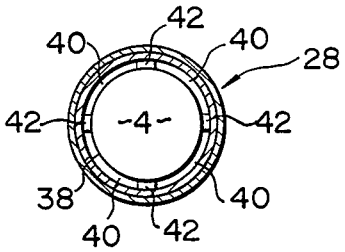
FIG. 15 is a sectional view taken along line XV—XV of FIG. 14.

In water filter 28 shown in FIGS. 14 and 15, ribs 42, e.g., four in number, are formed on the outer peripheral surface of water capsule 38. They are arranged circumferentially at regular intervals. A plurality of smoke passages 40 are secured between ribs 42.

Figure 16:
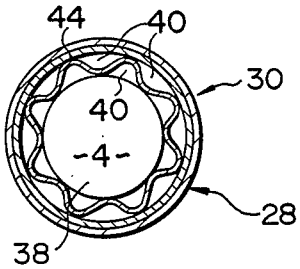
FIG. 16 is a cross-sectional view of another water filter.

Water filter 28 shown in FIG. 16 has corrugated sheet 44, which is wound around the outer peripheral surface of water capsule 38 so as to be situated between casing 30 and capsule 38. Also with use of such a sheet, a plurality of smoke passages 40 can be secured between casing 30 and capsule 38.

Figure 17:
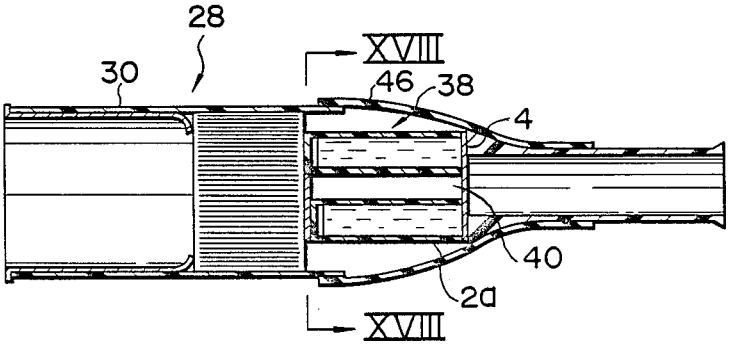
FIG. 17 is a sectional view of still another filter.
Figure 18:
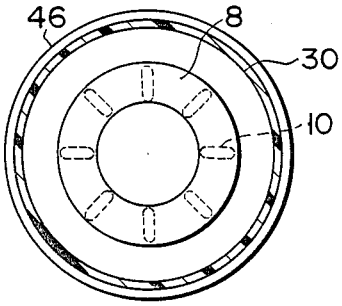
FIG. 18 is a sectional view taken along line XVIII—XVIII of FIG. 17.

Water filter 28 shown in FIGS. 17 and 18, unlike the embodiments described above, is formed as a so-called water pipe which is independent of cigarette 26. As seen from FIG. 17, water capsule 38 of pipe 28 includes body 2*a* of a double-pipe structure. Thus, end wall 8 and an open end of body 2, and therefore, seal film 4, are all ring-shaped. According to water capsule 38 constructed in this manner, axially extending smoke passage 40 can be secured in the central portion of the capsule. In water pipe 28, moreover, the greater part of casing 30 is formed of plastic material. Meanwhile, region 46 of casing 30 in which water capsule 38 is contained is formed of a flexible material, such as rubber. Thus, body 2*a* of capsule 38 can be easily crushed by externally applying force to casing 30.

In the embodiments described above, the water filter uses the easily breakable plastic capsule shown in FIG. 1. It is to be understood, however, that the easily breakable plastic capsules shown in FIGS. 4 to 7 can be used in place of the one shown in FIG. 1.

When using the easily breakable plastic capsule or water capsule shown in FIG. 6, for example, it is preferably substituted for the water capsule used in the embodiment of FIG. 12. In this arrangement, water capsule 38 of FIG. 6 is broken at both ends when it is unsealed. Accordingly, a space formed in capsule 38 after the discharge of the liquid can be utilized as smoke passage 40. In this case, smoke passage 40 between casing 30 and capsule 38 can be omitted, so that the outer peripheral surface of the capsule can be made to be in intimate contact with the inner peripheral surface of casing 30.

What is claimed is:

1. An easily breakable plastic capsule packed with a fluid material, comprising:

a hollow, cylindrical body formed of a plastic material and having one end closed by an end wall and another end which is open, said body having a packed chamber which is defined therein and which is to be packed with the fluid material, said body being elastically deformable when subjected to external force;

a seal film for sealing said another end of said body; and thin wall means, operatively associated with the end wall of the body, for causing the end wall to be broken when the body is subjected to external force, said thin wall means including;

(i) a plurality of radially extending grooves formed in one face of the end wall, except for a central portion of said one face; and (ii) a recess formed in the end wall such that radially inner ends of the adjacent grooves communicate with each other, said recess being formed in such a manner as to define a circular solid portion in the central portion of the end wall.

2. The capsule according to claim 1, wherein said grooves and said recess are formed in an inner face of the end wall which defines the packed chamber.

3. The capsule according to claim 2, wherein said recess is of a depth whereby it extends to a bottom of the groove.

4. The capsule according to claim 3, wherein said recess has a V-shaped cross-section.

5. The capsule according to claim 2, wherein said circular hollow portion extends from the inner face of the end wall.

6. The capsule according to claim 1, wherein a pair of inner wall portions defining each groove are slanted such that an open section of each said groove has a width greater than that of the bottom thereof.

7. The capsule according to claim 6, wherein said thin wall means includes radially extending grooves which are formed in the outer face of the end wall such that each of them form a groove pair together with the corresponding groove formed in the inner face.

8. The capsule according to claim 1, wherein said seal film includes a metal sheet and an adhesive layer formed of thermoplastic synthetic resin.

9. An easily breakable plastic capsule packed with a fluid material, comprising:

a hollow body formed of plastic material, said body having a packed chamber and capable of elastic deformation when subjected to external force, said packed chamber being sealable after being packed with the fluid material, said hollow body including a hollow cylindrical member having one end closed by an end wall and another open end;

at least one thin-walled region operatively provided with said end wall of the body, said thin-walled region being thinner than any other regions of the body and thin enough to be broken when the body is subjected to external force; and a seal film for sealing said another end of the body, wherein the peripheral wall of said body includes a taper portion reduced in wall thickness toward the end wall.

10. An easily breakable plastic capsule packed with a fluid material, comprising:

a hollow body formed of plastic material, said body having a packed chamber and capable of elastic deformation when subjected to external force, said packed chamber being sealable after being packed with the fluid material, said hollow body including a hollow cylindrical member having one end closed by an end wall and another open end;

at least one thin-walled region operatively provided with said end wall of the body, said thin-walled region being thinner than any other regions of the body and thin enough to be broken when the body is subjected to external force; and a seal film for sealing said another end of the body, wherein said body is formed, on the outer peripheral surface thereof, with a plurality of grooves extending within a predetermined range from the end wall and arranged at regular intervals in the circumferential direction of the body.

11. A water filter for a cigarette, comprising:

a flexible casing in the form of a tube open at both ends, one end of said casing serving as a socket for the cigarette and the other end serving as a mouthpiece;

at least one filter member for the cigarette contained in the casing and capable of being impregnated with a liquid;

an easily breakable plastic capsule disposed in close vicinity to the filter member in the casing; and guide means for guiding a flow of smoke from the cigarette into the casing, ranging from the socket to the mouthpiece, said capsule being a hollow, cylindrical body formed of a plastic material and having one end closed by an end wall and another end which is open, said body being arranged such that its end wall faces a filter member in the vicinity thereof and having a packed chamber which is defined therein and which is to be packed with a liquid mainly including water, said body being elastically deformable when subjected to external force;

a seal film for sealing said another end of said body, whereby the liquid is sealed in the packed chamber; and thin wall means, provided in operative association with the end wall of the body, for causing the end wall to be broken when the body is subjected to external force, said thin wall means including (i) a plurality of radially extending grooves formed in one face of the end wall, except for a central portion of said one face, and (ii) a recess formed in the end wall such that radially inner ends of the adjacent grooves communicate with each other, said recess being formed in such a manner as to define a circular solid portion in the central portion of the end wall.

12. The capsule according to claim 11, wherein said grooves and said recess are formed in an inner face of the end wall which defines the packed chamber.

13. The capsule according to claim 12, wherein said recess is of a depth whereby it extends to a bottom of the groove.

14. The capsule according to claim 13, wherein said recess has a V-shaped cross-section.

15. The capsule according to claim 12, wherein said circular hollow portion extends from the inner face of the end wall.

16. The capsule according to claim 11, wherein a pair of inner wall portions defining each groove are slanted such that an open section of each said groove has a width greater than that of the bottom thereof.

17. The capsule according to claim 16, wherein said thin wall means includes radially extending grooves which are formed in the outer face of the end wall such that each of them form a groove pair together with the corresponding groove formed in the inner face.

18. The capsule according to claim 11, wherein said seal film includes a metal sheet and an adhesive layer formed of thermoplastic synthetic resin.

19. The water filter according to claim 11, wherein said capsule is held between a pair of filter members in the casing.

20. The water filter according to claim 19, wherein said seal film is formed of an aluminum foil which is broken together with the end wall, when said body is elastically deformed.

21. The water filter according to claim 20, wherein said guide means includes a space inside the capsule provided after the liquid is discharged from the capsule.

22. The water filter according to claim 11, wherein said casing is made of paper, and said casing and said cigarette are coupled to each other by pasting.

23. The water filter according to claim 11, wherein said guide means includes a passage defined between the casing and the capsule.

24. A water filter for a cigarette, comprising:

a flexible casing in the form of a tube open at both ends, one end of said casing serving as a socket for the cigarette and the other end serving as a mouthpiece;

at least one filter member for the cigarette contained in the casing and capable of being impregnated with a liquid;

an easily breakable plastic capsule disposed in close vicinity to the filter member in the casing; and guide means for guiding a flow of smoke from the cigarette into the casing, ranging from the socket to the mouthpiece, said capsule including:

(i) a hollow cylindrical body formed of plastic material and capable of elastic deformation when subjected to external force, said cylindrical body having a packed chamber and an end wall in the vicinity of the filter member, said packed chamber being sealable after being packed with the liquid composed mainly of water, said cylindrical body including a hollow cylindrical member having one end closed by an end wall and another end which is open, (ii) at least one thin-walled region in operative association with the end wall of the body, said thin-walled region being thinner than any other regions of the body and thin enough to be broken when the body is subjected to external force applied through the casing, and (iii) a seal film for sealing said another end of the body, wherein (iv) the peripheral wall of said body includes a taper portion reduced in wall thickness toward the end wall.

25. A water filter for a cigarette, comprising:

a flexible casing in the form of a tube open at both ends, one end of said casing serving as a socket for the cigarette and the other end serving as a mouthpiece;

at least one filter member for the cigarette contained in the casing and capable of being impregnated with a liquid;

an easily breakable plastic capsule disposed in close vicinity to the filter member in the casing; and guide means for guiding a flow of smoke from the cigarette into the casing, ranging from the socket to the mouthpiece;

said capsule including:

(i) a hollow cylindrical body formed of plastic material and capable of elastic deformation when subjected to external force, said cylindrical body having a packed chamber and an end wall in the vicinity of the filter member, said packed chamber being sealable after being packed with the liquid composed mainly of water, said cylindrical body including a hollow cylindrical member having one end closed by an end wall and another end which is open, (ii) at least one thin-walled region in operative association with the end wall of the body, said thin-walled region being thinner than any other regions of the body and thin enough to be broken when the body is subjected to external force applied through the casing, and (iii) a seal film for sealing said another end of the body, wherein (iv) the body is formed, on the outer peripheral surface thereof, with a plurality of grooves extending within a predetermined range from the end wall and arranged at regular intervals in the circumferential direction of the body.

* * * * *